US006298706B1

(12) United States Patent
Dunn

(10) Patent No.: US 6,298,706 B1
(45) Date of Patent: Oct. 9, 2001

(54) APPARATUS FOR USE IN A PIPE BENDING MACHINE AND METHOD FOR BENDING PIPE

(75) Inventor: Christopher F. Dunn, Broken Arrow, OK (US)

(73) Assignee: CRC-Evans Pipeline International, Inc., Houston, TX (US)

( * ) Notice: Subject to any disclaimer, the term of this patent is extended or adjusted under 35 U.S.C. 154(b) by 0 days.

(21) Appl. No.: 09/469,669

(22) Filed: Dec. 22, 1999

(51) Int. Cl.[7] ..... B21D 7/10

(52) U.S. Cl. ..... 72/369; 72/380; 72/465.1

(58) Field of Search ..... 72/369, 380, 381, 72/382, 383, 388, 465.1, 466, 466.8, 466.9

(56) References Cited

U.S. PATENT DOCUMENTS

| | | | | |
|---|---|---|---|---|
| 1,741,840 | * | 12/1929 | Harmon et al. | 72/465.1 |
| 2,347,593 | * | 4/1944 | Cummings | 72/388 |
| 2,547,870 | * | 4/1951 | Kelso | 72/380 |
| 3,335,588 | * | 8/1967 | Cummings | 72/382 |
| 3,780,591 | * | 12/1973 | Clavin et al. | 72/466.8 |
| 4,313,330 | | 2/1982 | Cummings | 72/307 |
| 5,092,150 | | 3/1992 | Cunningham | 72/369 |
| 5,123,272 | | 6/1992 | Heaman | 72/389 |

* cited by examiner

*Primary Examiner*—Lowell A. Larson
(74) *Attorney, Agent, or Firm*—Sidley Austin Brown & Wood

(57) ABSTRACT

A pipe bending machine, a segmented bending die for use in a pipe bending machine, and a method for bending pipe are disclosed. The pipe bending machine includes a frame, a segmented bending die, a support structure, a stiffback, and a pin up shoe. A pipe is inserted in the pipe bending machine, over the pin up shoe, between the segmented bending die and the support structure, and onto the stiffback. By raising the stiffback upwardly and securing an end of the pipe with the pin up shoe, the pipe is bent against the segmented bending die. The segmented bending die and the support structure conform to the external surface contours of the pipe to support the walls of the pipe, thereby preventing distortion, buckling, flattening, or collapsing of the pipe during bending.

22 Claims, 6 Drawing Sheets

APPARATUS FOR USE IN A PIPE BENDING MACHINE AND METHOD FOR BENDING PIPE

TECHNICAL FIELD OF THE INVENTION

This invention relates to the bending of pipe, particularly larger diameter pipe having a diameter of a foot or more.

BACKGROUND OF THE INVENTION

A pipeline must, to some degree, follow the contour of the land through which the pipeline is laid. This is particularly true with underground pipe, which is becoming more prevalent. For example, a pipe passing under a ravine must often have appropriate bends to accommodate the ravine. In addition, with the increasing density of pipelines crossing the country, it is sometimes necessary for a section of a pipeline to be bent to avoid interfering with another pipeline.

Pipe bending machines have been developed that permit bending pipe to a desired degree. Examples of such pipe bending machines are machines disclosed in U.S. Pat. No. 5,092,150 issued on Jul. 19, 1991 to Cunningham and U.S. Pat. No. 5,123,272 issued on Sep. 30, 1991 to Heaman. As shown in these patents, the pipe is held in the bending machine by a pin up shoe and stiffback. The pin up shoe is positioned up and down by a wedge actuated by a hydraulic cylinder. The purpose of the wedge is to provide a mechanical advantage to the cylinder because the pin up shoe must restrain one end of the pipe during bending. The stiffback is positioned on the opposite side of a die and is raised and lowered by hydraulic cylinders. The stiffback bends the pipe around the radius of the fixed die, which acts as a fulcrum.

In general, as a pipe is bent, the outer part of the bend is stretched and the inner section of the bend is compressed. As a result of these opposite and unequal stresses, the pipe tends to distort, flatten, buckle, or even collapse, thereby destroying the utility of the pipe. Buckling occurs when the resistance to bending of the pipe becomes greater than the resistance to buckling. In addition, distortion is especially prevalent in large diameter, high strength, thin wall pipe that is bent in a cold condition and is commonly used in the pipeline industry.

Over the years, the tensile strength of steel pipe has been increased to allow the use of thinner wall pipe in the construction of pipelines. The reason for this change is the savings realized from the reduced amount of total steel required. However, it is well known that thin wall pipe distorts and buckles more easily than thicker wall pipe. Distortion and buckling are unacceptable. The most common location for distortion and buckling to originate is in the portion of the pipe adjacent to the last one third of the die.

To prevent distortion and buckling, the wall of the pipe must be supported in some manner during the bending operation to support the bend and thereby minimize the adverse effect of the opposite and unequal stresses induced during bending. Conventionally, this support has been in the form of a filling material or an internal mandrel that supports the inner wall. However, using a filling material or an internal mandrel is often not advantageous or practicable for many pipeline applications.

For example, using a filling material often requires filling the interior of the pipe with a combination of low melting point metals, such as bismuth, lead, tin, and cadmium, so that the pipe can be bent as a solid rod and the filling material can be melted away after bending. It may be impracticable to perform this operation for large diameter pipes because of the large quantities of filler materials and the long processing time that would be required. Furthermore, use of such filler materials may adversely affect the material properties of the pipe, such as corrosion resistance or strength.

In another example, using an internal mandrel requires selecting a mandrel specifically adapted for a particular range pipe bend radii, pipe diameters, pipe wall thicknesses, and pipe materials. The mandrel helps hold the pipe cross section round during the bend. The mandrel also typically has buckle-resisting strips that support the wall of the pipe during bending. Different mandrels must be selected as different types of pipe are bent to different radii, thereby increasing cost and delaying the pipe bending process. In addition, the mere process of inserting and aligning an internal mandrel is time consuming and also increases costs and delays the pipe bending process. Even when using an internal mandrel during bending, it is often difficult to hold the cross section of a pipe round during bending, which can also be detrimental to the corrosion coatings normally applied to the pipe. Also, distortion, flattening, buckling, and collapsing of the pipe may nevertheless occur even if an internal mandrel is used because an internal mandrel may not adequately support the bend.

Therefore, there is a need to develop technology for an improved means for supporting the bend of a pipe during pipe bending to minimize or prevent distortion, buckling, flattening, or collapsing of the pipe.

SUMMARY OF THE INVENTION

In accordance with one aspect of the present invention, an improved apparatus for use in a pipe bending machine is provided. The improved apparatus has a frame, a bending die, die segments, strips, and support segments. The bending die is supported on the frame. The die segments are disposed longitudinally along the bending die on an inner radius side of the pipe. Each of the die segments has an interior curved surface that faces the inner radius side of the pipe and substantially corresponds to the exterior curved surface of the pipe. The strips are disposed along the interior curved surfaces of the die segments. The strips are used for engaging the inner radius side of the pipe. Each of the strips are flexibly attached to the die segments and are disposed parallel to the axis of the pipe. The support segments are supported on the frame and are disposed proximate to and longitudinally along the outer radius of the pipe. Each of the support segments are independently moveable toward and away from the pipe for independently engaging the outer radius side of the pipe.

In accordance with another aspect of the present invention, an improved method for bending pipe is provided. The method includes the steps of: (1) providing a pipe to be bent, the pipe having an inner radius side, an outer radius side, a first end and a second end; (2) positioning the pipe between a segmented bending die having a face facing the inner radius side and a support structure having a face facing the outer radius side; (3) engaging the pipe on the inner radius side by adapting the face of the segmented bending die to conform to the inner radius side; (4) engaging the pipe on the outer radius side by adapting the face of the support structure to conform to the outer radius side; (5) securing the first end of the pipe; and (6) raising the second end of the pipe to effect bending.

BRIEF DESCRIPTION OF THE DRAWINGS

Reference is now made to the following detailed description, taken in conjunction with the accompanying drawings, wherein.

DETAILED DESCRIPTION

Figure 1:
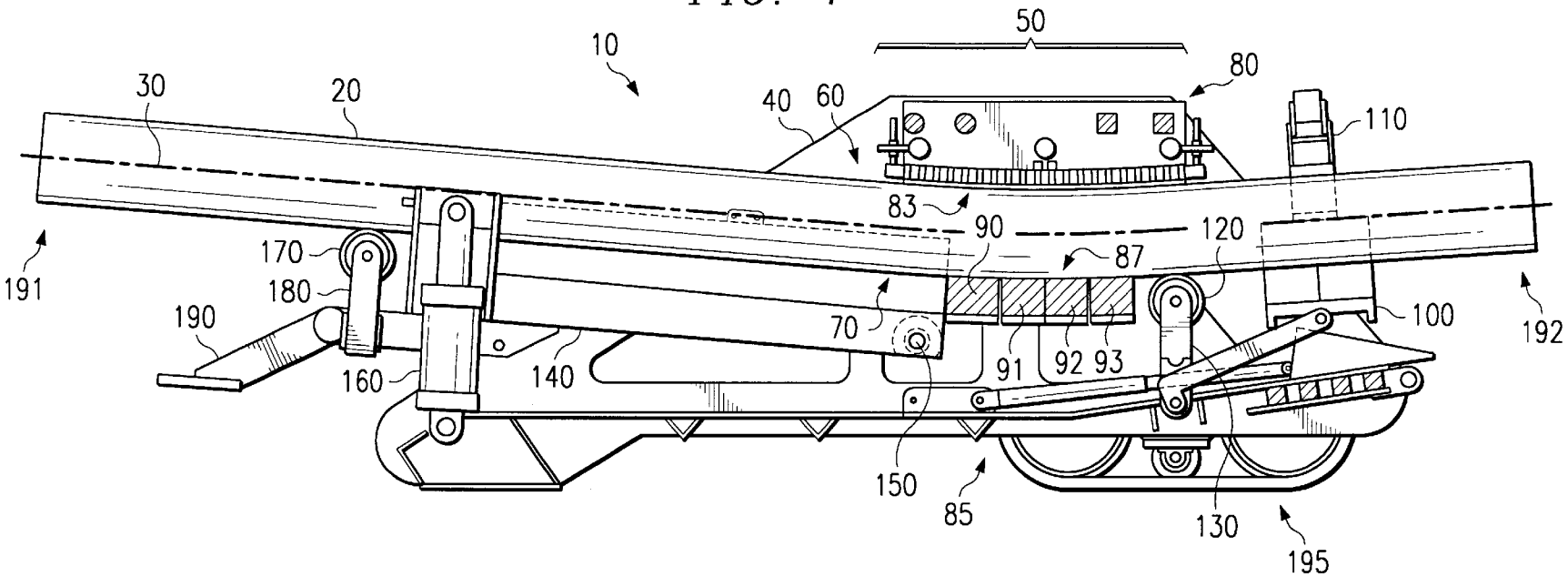
FIG. 1 is a side view of a pipe bending machine incorporating a preferred embodiment of the present invention with a pipe inserted into the pipe bending machine.
Figure 2:
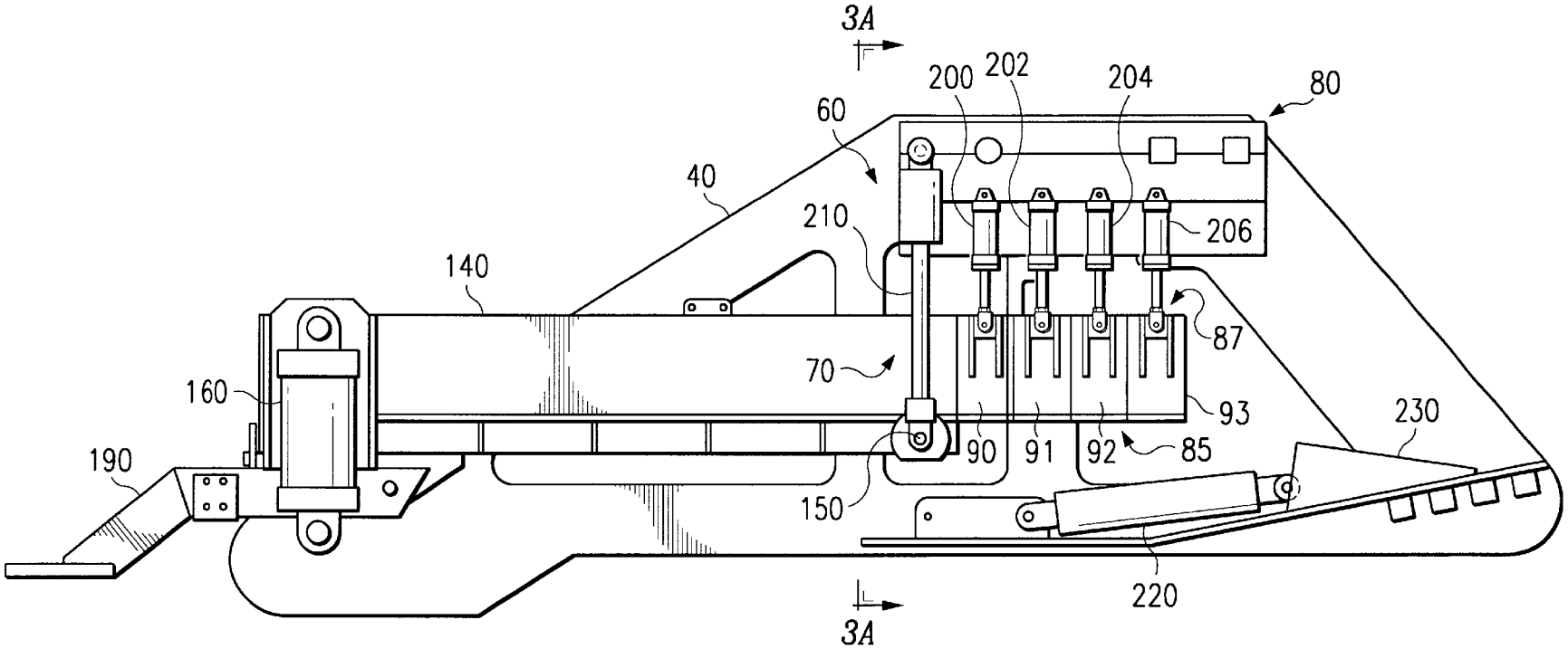
FIG. 2 is a side view of the pipe bending machine incorporating a preferred embodiment of the present invention without a pipe, and further illustrating the stiffback and interrelationship between the segmented bending die assembly and the support segments.

Referring to the drawings, wherein like reference numerals designate like or corresponding parts throughout the several views, FIGS. 1–2 illustrate a pipe bending machine 10.

FIG. 1 illustrates a pipe bending machine 10 that is used to bend a pipe 20. The pipe 20 has an axis 30. The pipe bending machine 10 employs a frame 40 upon which components of the pipe bending machine 10 are mounted. A desired curvature is imparted to the pipe 20 over a bending region 50. The pipe 20 has an inner radius side 60 and an outer radius side 70. The pipe 20 has an exterior curved surface that extends along the inner radius side 60 and the outer radius side 70. In a preferred embodiment, the pipe bending machine 10 bends pipe 20 using hydraulically-actuated mechanical forces.

Bending forces are imparted to the pipe 20 by the cooperation of a number of components. A segmented bending die assembly 80 is supported by the frame 40 and is located in the bending region 50 on the inner radius side 60 of pipe 20. The segmented bending die assembly 80 has a die face 83 and is located across the pipe 20 opposite a support structure 85, which has a support face 87 and includes a plurality of support segments 90–93. The plurality of support segments 90–93 is supported by frame 40 and is located proximate to bending region 50 on outer radius side 70. Each one of the support segments 90–93 is disposed in longitudinal series along the outer radius side 70 and in a direction generally parallel to axis 30. Each one of the support segments 90–93 is independently moveable toward and away from the pipe 20 for independently engaging the pipe 20 on the outer radius side 70.

A pin up shoe 100 is located at a first end of the pipe bending machine 10 and secures a corresponding end of the pipe 20. The securing function of pin up shoe 100 is further assisted by a pin up clamp 110 and a pin up roller assembly roller 120. The pin up clamp 110 is located on top of the pipe 20 and opposite pin up shoe 100. The pin up roller assembly roller 120 is rotationally attached to the pin up roller assembly 130, which is located below pipe 20, proximate to pin up shoe 100, and between the group of support segments 90–93 and the pin up shoe 100. The pin up clamp 110 further restrains and restricts movement of the corresponding end of the pipe 20. The pin up roller assembly roller 120, as supported by the pin up roller assembly 130, supports the pipe 20 from below while allowing the pipe 20 to slide longitudinally during set up and adjustment of the pipe bending machine 10.

A stiffback 140 is located at a second end of the pipe bending machine 10 and engages a corresponding end of pipe 20. The stiffback 140 is pivotally attached to the frame 40 at stiffback pivot 150. The stiffback 140 is actuated up and down about stiffback pivot 150 by a stiffback piston mechanism 160. In a preferred embodiment, the stiffback piston mechanism 160 is hydraulic. The engaging function of stiffback 140 is further assisted by a stiffback roller assembly roller 170, which is rotationally attached to stiffback roller assembly 180. The stiffback roller assembly roller 170, as supported by the stiffback roller assembly 180, supports the pipe 20 from below while allowing the pipe 20 to slide longitudinally during set up, adjustment, and bending operations of the pipe bending machine 10. The stiffback roller assembly 180 is secured to the stiffback 140. Tongue 190 is also secured to the stiffback 140. In a preferred embodiment, the stiffback roller assembly 180 is secured to the stiffback 140 by being secured to the tongue 190. The tongue 190 is used to pull along and tow the pipe bending machine 10.

In order to impart a desired curvature, bending forces are applied by securing the pipe 20 between the cooperating segmented bending die assembly 80, plurality of support segments 90–93, pin up shoe 100, and stiffback 140. Specifically, a pipe is inserted in the pipe bending machine 10 from either the first end 191 or the second end 192 of the pipe bending machine 10 (as illustrated on the left hand side and the right hand side of FIG. 1, respectively, which also correspond to the ends with the stiffback 140 and pin up shoe 100, respectively), over the pin up shoe 100, between the segmented bending die assembly 80 and the plurality of support segments 90–93, and onto the stiffback 140. In a preferred embodiment, powerful hydraulic cylinders, including stiffback piston mechanism 160, are activated to bend the pipe 20 about the segmented bending die assembly 80 by moving the non-pivoted end of the stiffback 140 upwardly about stiffback pivot 150.

The pin up shoe 100 supports the first end of pipe 20 and to prevent it from moving downward. The pin up clamp 110 further secures the first end of pipe 20 to prevent slippage and undesirable displacement during bending.

In a preferred embodiment, an internal mandrel is not used. However, in another preferred embodiment, an internal mandrel may be inserted within the pipe 20 at the point of the bend, which is generally located within bending region 50. The internal mandrel, if used, supports the inner walls of the pipe 20 to further ensure that the bending process does not cause distortion, collapse, or buckling of the walls of pipe 20.

In an additional preferred embodiment, the pipe bending machine 10 is transportable along the ground by means of a track system 195 attached to frame 40, as shown in FIG. 1. The track system 195 allows the pipe bending machine 10 to be pulled by a vehicle, such as a tractor (not shown).

FIG. 2 provides an additional side view of the pipe bending machine 10, but without a pipe 20. FIG. 2 has also been adapted to further illustrate the stiffback 140 and interrelationship between the segmented bending die assembly 80 and the support segments 90–93.

Each one of the support segments 90–93 is slidably attached to the frame 40 by at least one of a plurality of clamp down piston mechanisms 200–207, of which only clamp down piston mechanisms 200, 202, 204 and 206 are shown in FIG. 2 and clamp down piston mechanisms 201, 203, 205 and 207 are not shown. The clamp down piston mechanisms 200–207 compress the support segments 90–93 against the pipe 20 over the bending region 50, and thereby allow cooperation between the segmented bending die assembly 80 and the support segments 90–93 to support the walls of pipe 20 in the bending region 50 during bending. This cooperation further ensures that the bending process does not cause distortion, collapse, or buckling of the walls of pipe 20. In a preferred embodiment, each one of the support segments 90–93 is slidably attached to the frame 40 by a pair of corresponding clamp down piston mechanisms 200 and 201, 202 and 203, 204 and 205, and 206 and 207, respectively. In a preferred embodiment, the clamp down piston mechanisms 200–207 are actuated hydraulically. The clamp down piston mechanisms 200–207 are oriented generally vertically and located so as not to positionally interfere with pipe 20 when inserted in the pipe bending machine 10.

Also, an interconnection mechanism 210 pivotally links the segmented bending die assembly 80 and the stiffback 140 at the stiffback pivot 150 further support and stabilize frame 40, segmented bending die assembly 80, and support segments 90–93 during bending. The interconnection mechanism 210 provides added stability, support, and cooperation between the segmented bending die assembly 80 and the support segments 90–93, and thereby provides added support of the walls of pipe 20 in the bending region 50 during bending. In a preferred embodiment, the interconnection mechanism 210 is hydraulic.

Furthermore, a lower piston mechanism 220 is pivotally attached to frame 40 and located below the support segments 90–93 and proximate to the end of the frame 40 where the pin up shoe 100 is located. The lower piston assembly 220 is slidably and cooperatively attached to a pin up wedge 230, which is thereby slidably adjustable on a portion of the frame 40 to provide positionally adjustable support to the pin up shoe 100. In particular, the pin up wedge 230 provides a mechanical advantage to the lower piston mechanism 220 since the pin up shoe 100 must restrain one end of the pipe 20 during bending.

Figure 3A:
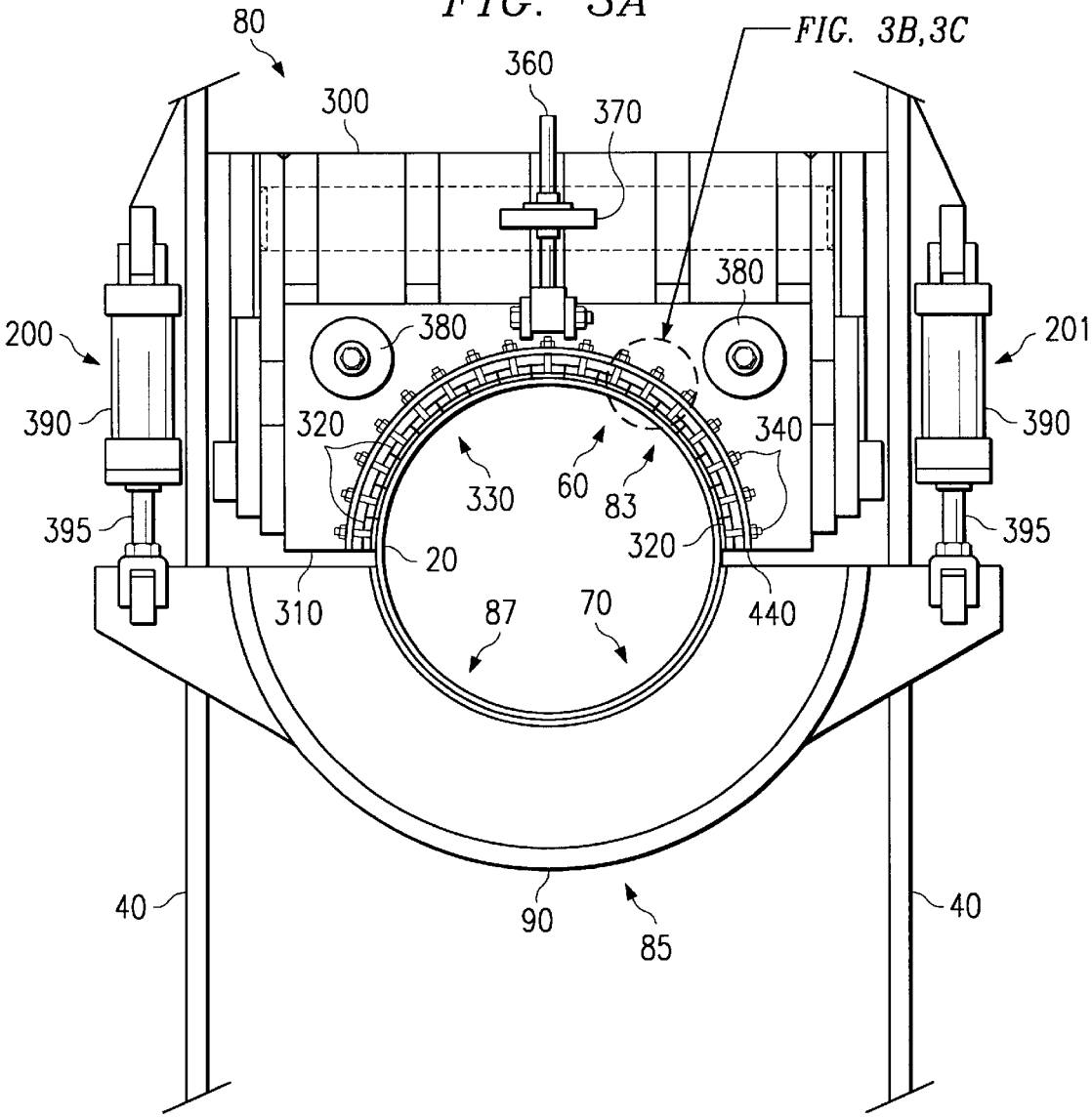
FIG. 3A is a front view of the pipe bending machine taken along lines 3A—3A in FIG. 2.

FIG. 3A is a front view of the pipe bending machine 10 taken along line 3A—3A in FIG. 2 in the direction of the arrows. This front view, which is also a cross-sectional view, further illustrates the detailed arrangement and cooperation between the segmented bending die assembly 80 and the support segments 90–93, of which only support segment 90 is shown in FIG. 2

A pipe 20 is inserted in the pipe bending machine 10. The upper half portion of the pipe corresponds to the inner radius side 60 and the lower half portion of the pipe corresponds to the outer radius side 70. As shown in FIG. 3A, support segment 90 engages the pipe 20 on the outer radius side 70. The segmented bending die assembly 80 engages the pipe 20 on the inner radius side 60.

The basic components of the segmented bending die assembly 80 comprise a bending die 300, die segments 310, and a plurality of strips 320.

Figure 3B:
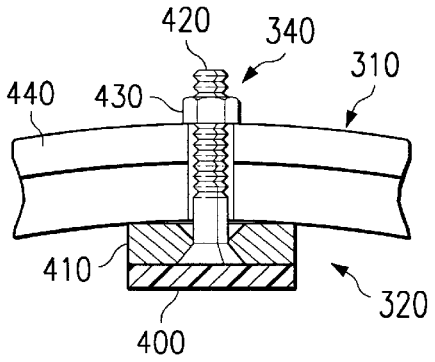
FIG. 3B is a close up view of a strip, as indicated in FIG. 3A, illustrating one aspect of the present invention.
Figure 3C:
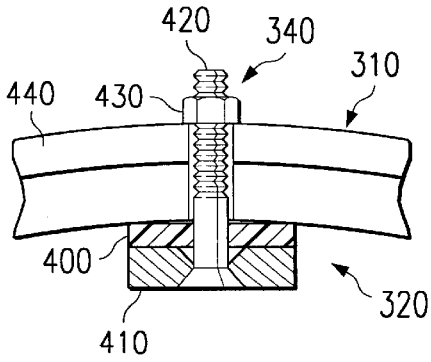
FIG. 3C is a close up view of a strip, as indicated in FIG. 3A, illustrating a second aspect of the present invention.

The strips 320 engage the pipe 20 on the inner radius side 60. The strips 320 bridge between the semicircular die segments 310 to make a smooth bending surface against the pipe 20. The strips 320 act as external buckle resisting strips similar as on a conventional internal mandrel. The strips 320 are disposed about the inner radius side 60 to form a semicircularly arranged face upon which pipe 20 is bent. Each one of the strips 320 is longitudinally shaped such that its length runs along and is generally equal to the length of the segmented bending die assembly 80 and its width is substantially shorter than its length so as to permit improved engagement of the pipe 20 over the inner radius side 60. The strips 320 are disposed longitudinally along and about the inner radius side 60 and are generally parallel to the axis 30. Thus, FIG. 3A, as well as FIGS. 3B and 3C, illustrate a cross-sectional view of each one of the strips 320 as they are positionally cast about the pipe 20 over the inner radius side 60. In a preferred embodiment, the strips 320 number seventeen (17). Each one of the strips 320 is flexible so as to permit continuously conforming engagement of the pipe 20 over the inner radius side 60 during bending. In a preferred embodiment, each one of the strips 320 has the following dimensions: a length of about 70¾ inches, a width of about 1⅞ inches and a thickness of about ¾ inch. However, these dimensions and quantities of the strips 320 can vary substantially depending on the length, diameter, dimensions, and type of pipe being bent.

A plurality of semicircular die segments 310 is located on a side of the strips 320 opposite the pipe 20. FIG. 2 illustrates only one of the die segments 310, since the view is limited to a front or otherwise cross sectional view of the pipe bending machine 10. Each one of the die segments 310 has an interior curved surface 330 that is proximate to the strips 320, the pipe 20, and the inner radius side 60. The shape of the interior curved surface 330 is semicircular, that is, concave and cast transverse to the axis 30 so as to accommodate the pipe 20 during engagement of the segmented bending die assembly 80 during bending. In a preferred embodiment, the ends of the strips 320 are flexibly attached to the ends of the segmented bending die assembly 80 by means of a fastener assembly 340. Furthermore, each one of the die segments 310 can independently move toward and away from the pipe 20. This arrangement permits each one of the die segments 310 to adjust so as to continuously conform to the changing longitudinal profile of the pipe 20 as it is bent, thereby causing the strips 320 to flex for continuously conforming engagement of the pipe 20 over the inner radius side 60 during bending. In a neutral position when bending is not occurring, the die segments 310 lie in a generally level horizontal position above the pipe 20.

A bending die 300 is secured to the frame 40 and is located above the plurality of die segments 310, the strips 320, and the pipe 20. The bending die 300 has a bending die surface 350 that faces the pipe 20 and that is longitudinally convex, which is a feature that is not best illustrated by FIG. 2, but better illustrated by FIG. 4B and further discussed below. The bending die surface 350 secures and limits the vertical displacement of each of the die segments 310, thereby allowing the strips 320 to create a firm engaging surface against which the pipe 20 is bent.

A plurality of supports 360 connect the bending die 300 to the die segments 310. In a preferred embodiment, the supports 360 number two (2), with each one of the supports 360 located at opposite longitudinal ends of the segmented bending die assembly 80. The upper end of each one of the supports 360 is slidably mounted to the bending die 300 through one of a plurality of brackets 370. In a preferred embodiment, the brackets 370 number two (2), with each one of the brackets 370 mounted on opposite longitudinal ends of the bending die 300 corresponding to the location of the supports 360. The lower end of each one of the supports 360 is pivotally mounted one of die segments 310 located at a similarly corresponding longitudinal end of the segmented bending die assembly 80. Although the supports 360 are secured by the brackets 370 to support the die segments 310 and strips 320, each of the supports 360 can slidably move up and down through one of the corresponding brackets 370, toward and away from the pipe 20, thereby being adaptable to adjust its profile. As a result of this connective cooperation between the bending die 300 and the die segments 310, the die segments 310 and the strips 320 can also move toward and away from the pipe 20. Thus, the combined structure of the die segments 310 and strips 320 can float between the bending die 300 and the pipe 20 and thereby provide a surface against which the pipe 20 is bent and where the strips 320 flex for continuously conforming engagement of the pipe 20 over the inner radius side 60 during bending.

A plurality of flexible assemblies 380 serve as a set of spines upon which each of the die segments 310 are mounted so as to allow interconnection of the die segments 310 as a unit. In a preferred embodiment, the flexible assemblies 380 number two (2) and each one of the flexible assemblies 380 is located on either side of the face of the die segments 310, and above and away from the region encompassed by the strips 320, the corresponding fastener assemblies 340, and the interior curved surface 330. The flexible assemblies 380 are independently and longitudinally mounted through each of the die segments 310 and are oriented to be generally parallel to the axis 30. In a preferred embodiment, the flexible assemblies 380 are not mounted directly to the bending die 300 or to the frame 40, but only among the die segments 310. This independent mounting of the flexible assemblies 380 allows each of the die segments 310 to move slightly in relation to the adjacent die segments 310, thereby further contributing to the continuously conforming engagement to the pipe 20 over the inner radius side 60 during bending.

As illustrated in FIG. 3A, a pair of clamp down piston mechanisms 200 and 201 are located on either side of the segmented bending die assembly 80 and the support segment 90 and are oriented generally vertically. The clamp down piston mechanisms 200 and 201 are arranged so as not to positionally interfere with pipe 20 when inserted in the pipe bending machine 10. The clamp down piston mechanisms 200 and 201, along with clamp down piston mechanisms 202–207 (not shown), compress the segmented bending die assembly 80, support segment 90, as well as support segments 91–93 (not shown), against the pipe 20 over the bending region 80, and thereby allow cooperation between the segmented bending die assembly 80 and the support segments 90–93 to support the walls of pipe 20 in the bending region 50 during bending. In particular, the top end of each of the clamp down piston mechanisms 200–207 is affixed to the bending die 300 and the bottom end of each of the clamp down piston mechanisms 200–207 is affixed to one of the corresponding support segments 90–93. In a preferred embodiment, each of the clamp down piston mechanisms 200–207 is comprised of a clamp down piston cylinder 390 and a clamp down piston rod 395. The clamp down piston rod 395 is slidably secured to the clamp down piston cylinder 390 for hydraulic actuation and support of the pipe 20 during bending.

As illustrated in FIGS. 3B–3C, in a preferred embodiment, each one of the strips 320 has two sides, namely a urethane side 400 and a steel side 410. In a preferred embodiment, the urethane side 400 has a thickness of ¼ inch and the steel side 410 has a thickness of ½ inch. In a preferred embodiment, the specific type of steel is 4130 cold finish flat. However, in other preferred embodiments, each side of the strips 320 can be composed of materials with properties different that urethane and steel and in different combinations. For example, the urethane could be replaced by different polymeric material types, such as rubber, polyethylene, polypropylene, PVC, and polystyrene. And, for example, the steel could be replaced by metallic alloys of iron, nickel, aluminum, copper, magnesium, titanium, tin, zinc, and lead. In yet another preferred embodiment, each of the strips 320 is made of the same material. Each fastener assembly 340 is comprised of a fastening bolt 420 and a fastening nut 430 that secures one end of the fastening bolt 420. Thus, it is an advantage of the present invention that each one of the strips 320 can be removed and replaced if damaged during operation.

As illustrated in FIGS. 3B–3C, the strips 320 can be configured in two aspects, depending on the characteristics desired for the surface against which the pipe 20 will be bent.

In a first aspect, as illustrated in FIG. 3B, each one of the strips 320 is installed such that the urethane side 400 is facing toward the pipe 20, whereas the steel side 410 is facing away from the pipe 20. The configuration of the first aspect helps prevent damage to the outer surface of the pipe 20, and is particularly advantageous if the pipe 20 has been coated with a material that might be susceptible to damage under these circumstances.

In a second aspect, as illustrated in FIG. 3C, each one of the strips 320 is installed such that the steel side 410 is facing toward the pipe 20, whereas the urethane side 400 is facing away from the pipe 20. The configuration of the second aspect allows the pipe to slip to a limited degree. This slippage can be important in certain cases where one is bending a pipe 20 that has been coated with materials that could be damaged by shearing forces at the interface between the pipe 20 and the segmented bending die assembly 80.

Figure 4A:
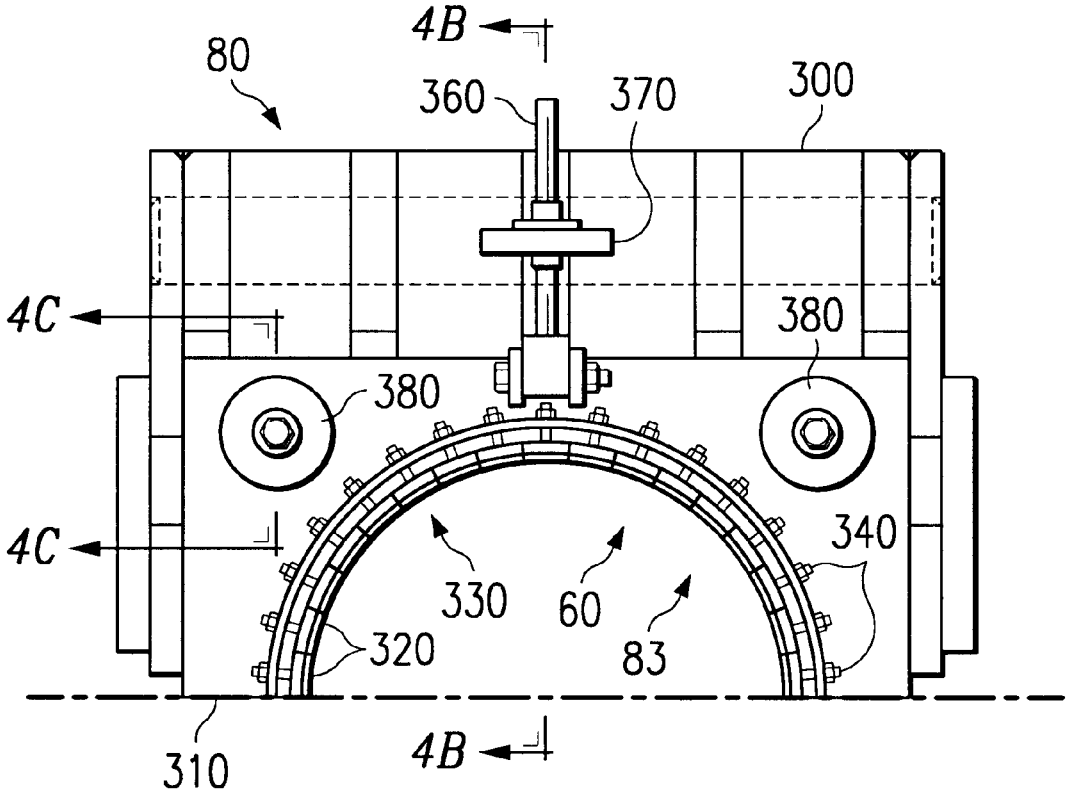
FIG. 4A is a front view of the segmented bending die shown in FIG. 4B.

FIG. 4A is a front view of the segmented bending die assembly 80 alone. As previously discussed in detail above, FIG. 4A illustrates the configuration of the basic components that comprise the segmented bending die assembly 80, including the bending die 300, one of the die segments 310, and the strips 320. FIG. 4A further illustrates the more detailed components of the segmented bending die assembly 80, including interior curved surface 330, the fastener assembly 340, one of the supports 360, one of the brackets 370, and two of the flexible assemblies 380. However, the bending die surface 350 is not evident in a front view and is therefore not best shown by FIG. 4A, as was discussed above in FIG. 3A, but shown better by FIG. 4B and the corresponding discussion that follows FIG. 4B.

Figure 4B:
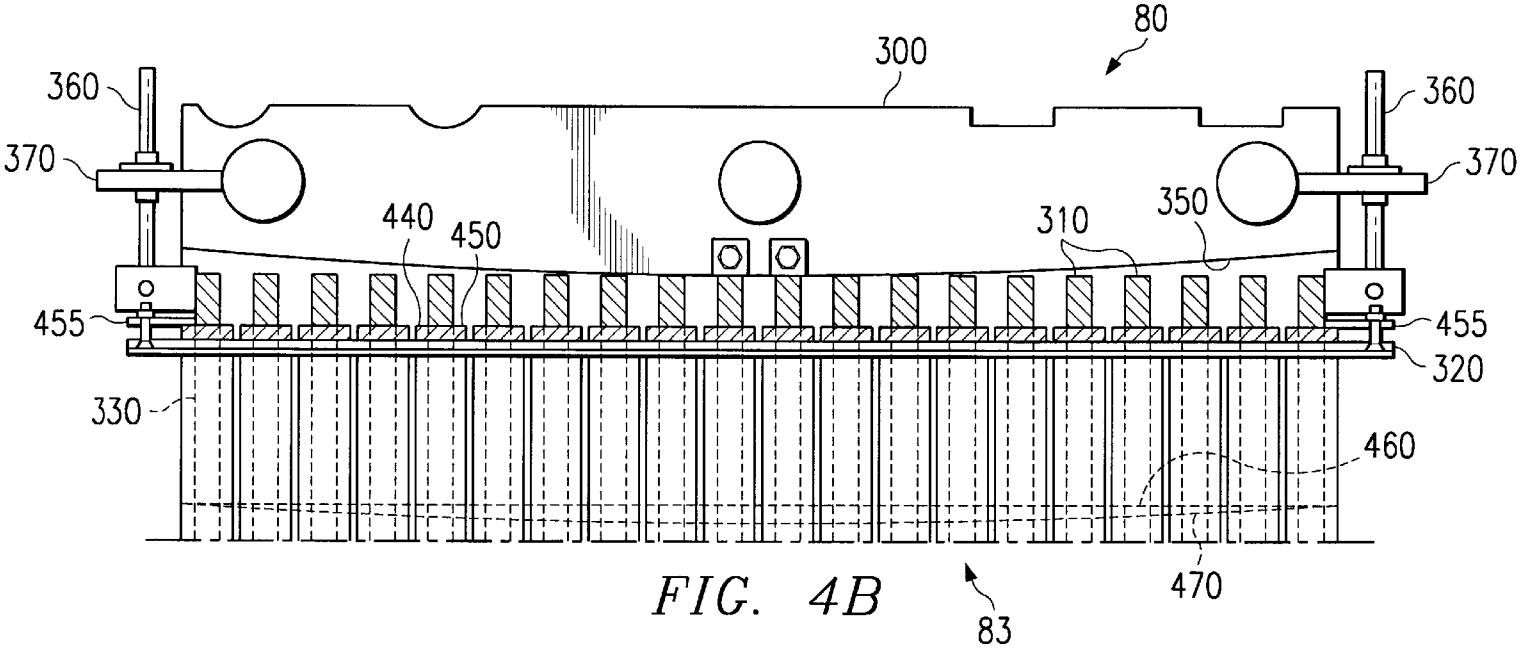
FIG. 4B is a side view of the segmented bending die taken along line 4B—4B in FIG. 4A.

FIG. 4B is a side view of the segmented bending die assembly 80 taken along line 4B—4B in FIG. 4A in the direction of the arrows. FIG. 4B further illustrates the configuration of the individual components of the segmented bending die assembly 80, especially the bending die surface 350. As discussed above, the segmented bending die assembly 80 is comprised of three basic components, namely the bending die 300, a plurality of die segments 310, and a plurality of strips 320.

The plurality of die segments 310 are located below the bending die 300 and disposed in series along the lower length of the bending die 300. The bending die surface 350 is located on the lower portion of the bending die 300. The bending die surface 350 is convexly and longitudinally curved downward toward the die segments 310. In a preferred embodiment, each of the die segments 310 is flanged longitudinally, fore and aft along the axis 30, so as to have a first flange section 440 and a second flange section 450. The first flange section 440 and second flange section 450 features serve to separate the outer portions of each one of the die segments 310. This separation will assist the detailed configuration and function of the flexible assembly 380, which is discussed below in the discussion of FIG. 4C.

Each of the strips 320 is longitudinally oriented along the length of the segmented bending die assembly 80. For clarity, FIG. 4B illustrates only one of the strips 320, namely the topmost one of the strips 320. A plurality of supports 360 connect the bending die 300 to the die segments 310. In a preferred embodiment, the supports 360 number two (2), with each one of the supports 360 located at opposite longitudinal ends of the segmented bending die assembly 80. The upper end of each one of the supports 360 is slidably mounted to the bending die 300 through one of a plurality of brackets 370. In a preferred embodiment, the brackets 370 number two (2), with each one of the brackets 370 mounted on opposite longitudinal ends of the bending die 300. The lower end of each one of the supports 360 is pivotally mounted one of die segments 310 located at a corresponding longitudinal end of the segmented bending die assembly 80. Each of the supports 360 can slidably move up and down through the bracket 370, toward and away from the pipe 20. As a result of this connective cooperation between the bending die 300 and the die segments 310, the die segments 310 and the strips 320 can move toward and away from the pipe 20. Thus, the combined structure of the die segments 310 and strips 320 can float as a flexible unit between the bending die 300 and the pipe 20 and thereby provide a surface against which the pipe 20 is bent where the strips 320 flex for continuously conforming engagement of the pipe 20 and its longitudinal and horizontal profile over the inner radius side 60 during bending. Furthermore, the bending die surface 350 secures and limits the vertical displacement of each of the die segments 310, thereby allowing the strips 320 to create a firm engaging surface against which the pipe 20 is bent. This feature is illustrated by first profile 460, which shows the general longitudinal and horizontal profile of the die segments 310 and one of the strips 320 when the segmented bending die assembly 80 is in a neutral position, and by second profile 470, which shows the general longitudinal and horizontal profile of the die segments 310 and one of the strips 320 when the segmented bending die assembly 80 is in a actuated position during bending.

Figure 4C:
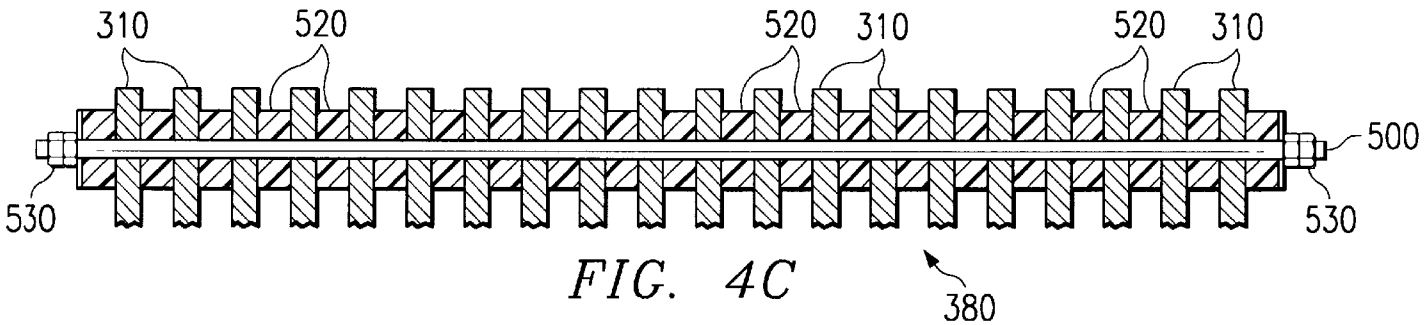
FIG. 4C is a side view of a flexible assembly taken along line 4C—4C in FIG. 4A in the direction of the arrows.

FIG. 4C is a side view of a flexible assembly 380 taken along line 4C—4C in FIG. 4A in the direction of the arrows. FIG. 4C illustrates the details of the flexible assembly 380 that allows each of the die segments 310 to move slightly in relation to the adjacent die segments 310, thereby contributing to the continuously conforming engagement to the pipe 20 over the inner radius side 60 during bending. The flexible assembly 380 is comprised of longitudinal spring steel rod 500, a rod end nut 520, and a plurality of urethane discs 510. The longitudinal spring steel rod 500 longitudinally pierces each of the die segments 310. Between each one of the die segments 310, one of the urethane discs 510 is sandwiched and is mounted on the longitudinal spring steel rod 500. In a preferred embodiment, this sandwiching arrangement is assisted by the separation between die segments 310 achieved by the first flange section 440 and second flange section 450 features, as discussed above in the discussion of FIG. 4B. One of the urethane discs 510 is mounted at each end of the longitudinal spring steel rod 500. One of the rod end nuts 520 is fastened at each end of the longitudinal spring steel rod 500, outside of the urethane discs 510 and the die segments 310, to keep the flexible assembly 380 as well as the die segments 310 secured together as a unit. As a result, the following sandwiched and alternating structure is formed along the longitudinal spring steel rod 500: [rod end nut 520]-[urethane disc 510]-[die segment 310]- . . . -[urethane disc 510]-[die segment 310]-[rod end nut 520].

Figure 5A:
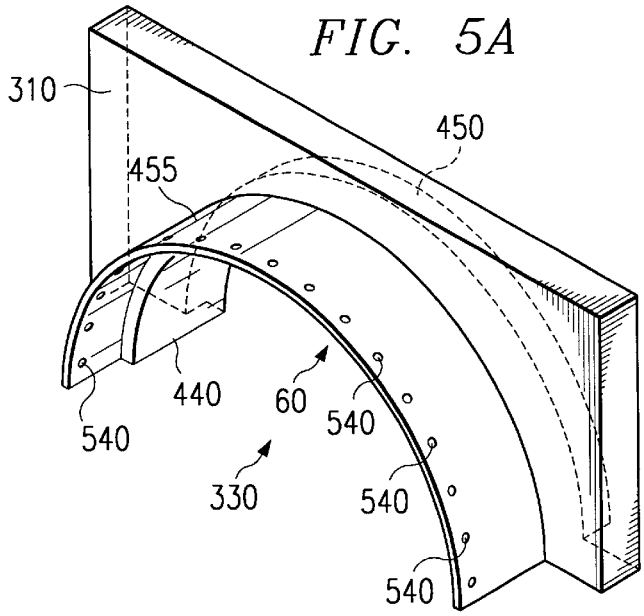
FIG. 5A is a perspective view of one of the individual die segments.
Figure 5B:
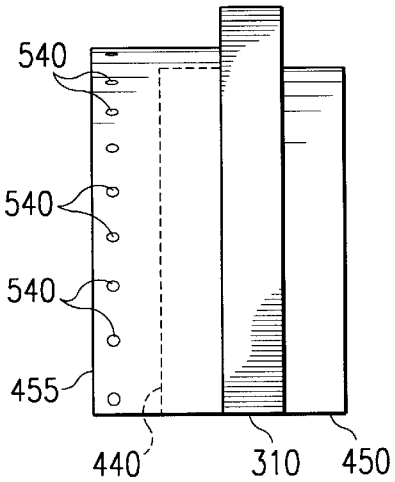
FIG. 5B is a side view of one of the individual die segments.

FIG. 5A is a perspective view of one of the individual die segments 310. FIG. 5B is a side view of one of the individual die segments 310. In particular, the die segment illustrated in FIGS. SA and 5B is the die segment 310 also illustrated in FIG. 3A and FIG. 4A. A first flange section 440 and a second flange section 450 are disposed on both sides of die segment 310. The flange sections 440 and 450 define the semicircularly-shaped interior curved surface 330, which conforms to the inner radius side 60. In a preferred embodiment, a third flange section 455 defines a plurality of holes 540. Each one of the holes 540 pierces through the flange section in a direction toward the interior curved surface 330. Each of the holes 540 is sized and adapted to accommodate a fastener assembly 340 so as to flexibly attach the strips 320 to the die segments 310. In other examples of die segment 310, such as the die segment at the opposite end of the segmented bending die assembly 80, another flange section on the other side of the die segment 310 defines the plurality of holes 540.

Figure 6:
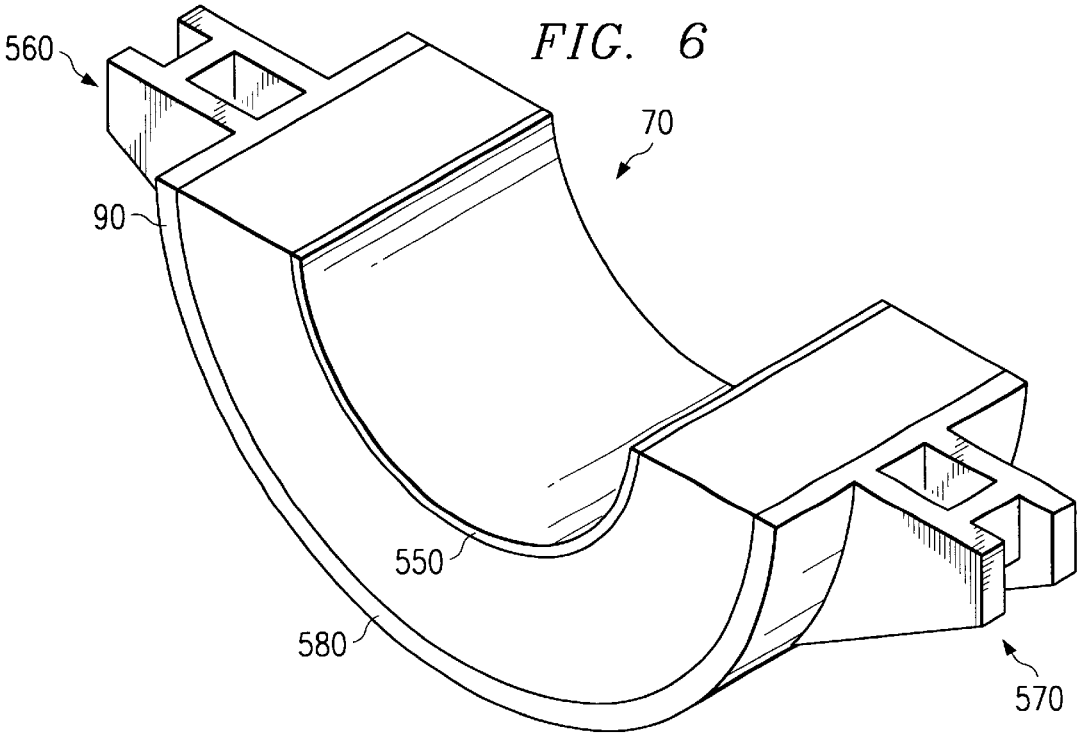
FIG. 6 is a perspective view of one of the individual support segments.

FIG. 6 is a perspective view of support segment 90 and is representative of support segments 91–93. Support segment 90 defines a semicircularly-shaped interior curved surface 550, which conforms to the outer radius side 70. A pair of brackets 560 and 570 are attached to the support segment 90 on its outboard sides. The brackets 560 and 570 serve as attachment points for corresponding clamp down piston mechanisms 200 and 201, respectively. The support segment 90 has an exterior curved surface 580, to which the pair of brackets 560 and 570 are attached.

In another preferred embodiment of the present invention, the support segments 90–93 can engage the pipe 20 by means of a plurality of strips 320 flexibly attached to the face of the support segments 90 on an outer radius side 70, in a configuration analogous to that described above for the segmented bending die assembly 80 on the inner radius side 60. This provides for improved continuously conforming engagement of the pipe 20 over the outer radius side 70 during bending.

Therefore, using the pipe bending machine 10 described above and illustrated in FIGS. 1, 2, 3A–C, 4A–C, 5A–B, and 6, a section or length of pipe 20 can be bent by the following method: (1) providing a pipe 20 to be bent, the pipe having an inner radius side 60, an outer radius side 70, a first end 191 and a second end 192; (2) positioning the pipe 20 between a segmented bending die assembly 80 having a face 83 facing the inner radius side 60 and a support structure 85 having a face 87 facing the outer radius side 70; (3) engaging the pipe 20 on the inner radius side 60 by adapting the face 83 of the segmented bending die assembly 80 to conform to the inner radius side 60; (4) engaging the pipe 20 on the outer radius side 70 by adapting the face 87 of the support structure 85 to conform to the outer radius side 70; (5) securing the first end 191 of the pipe 20; and (6) raising the second end 192 of the pipe 20 to effect bending.

In a further preferred embodiment of the present invention, the segmented bending die assembly 80 is the sole component that is adapted to be inserted into other existing bending machines so as to provide a means to prevent pipe buckling in existing bending machines.

In yet another preferred embodiment of the present invention, more than one segmented bending die assembly 80 may be used to bend pipe 20 with simultaneously different radii over the length of the pipe 20.

While a discrete number of embodiments of the present invention has been described in detail herein and shown in the accompanying drawings, it will be evident that further modifications or substitutions of parts and elements are possible without departing from the scope and spirit of the invention.

What is claimed is:

1. Apparatus for use in a pipe bending machine, wherein the pipe is bent to have an inner radius side and an outer radius side, the apparatus comprising:

a frame;

a bending die supported on said frame;

a plurality of die segments disposed longitudinally along said bending die on said inner radius side of said pipe, each of said die segments having an interior curved surface that faces said inner radius side of said pipe and substantially corresponds to an exterior curved surface of said pipe;

a plurality of strips disposed along said interior curved surfaces of said die segments for engaging said inner radius side of said pipe, each of said plurality of strips being flexibly attached to said die segments, and each of said strips being disposed parallel to the axis of said pipe; and a plurality of support segments supported on said frame and disposed proximate to and longitudinally along said outer radius side of said pipe, each of said plurality of support segments being independently moveable toward and away from said pipe for independently engaging said outer radius side of said pipe.

2. An apparatus in accordance with claim 1, wherein each of said strips has a first side and a second side, said first side being comprised of a polymeric material and said second side being comprised of a metallic material.

3. An apparatus in accordance with claim 2, wherein said polymeric material is urethane and said metallic material is steel.

4. An apparatus in accordance with claim 2, wherein said first side faces toward said pipe and said second side faces away from said pipe.

5. An apparatus in accordance with claim 2, wherein said second side faces toward said pipe and said first side faces away from said pipe.

6. A segmented bending die for use in a pipe bending machine, wherein the pipe is bent to have an inner radius side and an outer radius side, the segmented bending die comprising:

a bending die;

a plurality of die segments disposed longitudinally along said bending die on said inner radius side of said pipe, each of said die segments having an interior curved surface that faces said inner radius side of said pipe and substantially corresponds to an exterior curved surface of said pipe; and a plurality of strips disposed along said interior curved surfaces of said die segments for engaging said inner radius side of said pipe, each of said plurality of strips being flexibly attached to said die segments, and each of said strips being disposed parallel to the axis of said pipe.

7. An apparatus in accordance with claim 6, wherein each of said strips has a first side and a second side, said first side being comprised of a polymeric material and said second side being comprised of a metallic material.

8. An apparatus in accordance with claim 7, wherein said polymeric material is urethane and said metallic material is steel.

9. An apparatus in accordance with claim 7, wherein said first side faces toward said pipe and said second side faces away from said pipe.

10. An apparatus in accordance with claim 7, wherein said second side faces toward said pipe and said first side faces away from said pipe.

11. A pipe bending machine, wherein the pipe is bent to have an inner radius side and an outer radius side, the machine comprising:

a frame;

a segmented bending die supported on said frame on said inner radius side of said pipe;

a support structure supported on said frame on said outer radius side of said pipe;

a stiffback pivotally supported at a first end of said frame for raising an end of said pipe to thereby bend said pipe against said bending die; and a pin up shoe supported at a second end of said frame for restraining another end of said pipe during bending;

wherein said segmented bending die comprises:

a bending die supported on said frame;

a plurality of die segments disposed longitudinally along said bending die on said inner radius side of said pipe, each of said die segments having an interior curved surface that faces said inner radius side of said pipe and substantially corresponds to an exterior curved surface of said pipe; and a plurality of strips disposed along said interior curved surfaces of said die segments for engaging said inner radius side of said pipe, each of said plurality of strips being flexibly attached to said die segments, and each of said strips being disposed parallel to the axis of said pipe.

12. An apparatus in accordance with claim 11, wherein each of said strips has a first side and a second side, said first side being comprised of a polymeric material and said second side being comprised of a metallic material.

13. An apparatus in accordance with claim 12, wherein said polymeric material is urethane and said metallic material is steel.

14. An apparatus in accordance with claim 12, wherein said first side faces toward said pipe and said second side faces away from said pipe.

15. An apparatus in accordance with claim 12, wherein said second side faces toward said pipe and said first side faces away from said pipe.

16. A pipe bending machine, wherein the pipe is bent to have an inner radius side and an outer radius side, the machine comprising:

a frame;

a segmented bending die supported on said frame on said inner radius side of said pipe;

a support structure supported on said frame on said outer radius side of said pipe;

a stiffback pivotally supported at a first end of said frame for raising an end of said pipe to thereby bend said pipe against said bending die; and a pin up shoe supported at a second end of said frame for restraining another end of said pipe during bending;

wherein said support structure comprises a plurality of support segments supported on said frame and disposed proximate to and longitudinally along said outer radius side of said pipe, each of said plurality of support segments being independently moveable toward and away from said pipe for independently engaging said outer radius side of said pipe.

17. A pipe bending machine in accordance with claim 16, further comprising a pin up shoe hold down mechanism disposed opposite said pin up shoe for further restraining another end of said pipe during bending.

18. A pipe bending machine in accordance with claim 16, further comprising a stiffback piston mechanism for hydraulically raising an end of said pipe to thereby bend said pipe against said bending die.

19. A pipe bending machine in accordance with claim 16, further comprising a plurality of clamp down piston mechanisms that connect support segments of said segmented bending die to said frame.

20. A method for bending pipe comprising:

providing a pipe to be bent, said pipe having an inner radius side, an outer radius side, a first end, and a second end;

positioning said pipe between a segmented bending die having a face facing said inner radius side and a support structure having a face facing said outer radius side;

engaging said pipe on said inner radius side by adapting said face of said segmented bending die to conform to said inner radius side;

engaging said pipe on said outer radius side by adapting said face of said support structure to conform to said outer radius side;

securing said first end of said pipe; and raising said second end of said pipe to effect bending wherein said segmented bending die comprises:

a bending die;

a plurality of die segments disposed longitudinally along said bending die on said inner radius side of said pipe, each of said die segments having an interior curved surface that faces said inner radius side of said pipe and substantially corresponds to an exterior curved surface of said pipe; and a plurality of strips disposed along said interior curved surfaces of said die segments for engaging said inner radius side of said pipe, each of said plurality of strips being flexibly attached to said die segments, and each of said strips being disposed parallel to the axis of said pipe.

21. A method in accordance with claim 20, wherein said step of engaging said pipe on said inner radius side occurs longitudinally and transversely.

22. A method in accordance with claim 20, wherein said step of engaging said pipe on said outer radius side occurs transversely.

* * * * *